US006449775B1

(12) United States Patent
Battaglia

(10) Patent No.: US 6,449,775 B1
(45) Date of Patent: Sep. 17, 2002

(54) CONNECTING BAND BETWEEN ARTICLES OF CLOTHING OR PARTS OF THEM

(76) Inventor: Gianpaolo Battaglia, Via Pacinotti, 4 - 36060 Romano d'Ezzelino (VI) (IT)

( * ) Notice: Subject to any disclaimer, the term of this patent is extended or adjusted under 35 U.S.C. 154(b) by 0 days.

(21) Appl. No.: 09/890,400

(22) PCT Filed: Feb. 7, 2000

(86) PCT No.: PCT/EP00/00951

§ 371 (c)(1),
(2), (4) Date: Sep. 19, 2001

(87) PCT Pub. No.: WO00/47071

PCT Pub. Date: Aug. 17, 2000

(30) Foreign Application Priority Data

Feb. 8, 1999 (IT) ..... VI99A0020

(51) Int. Cl.[7] ..... A41F 9/00
(52) U.S. Cl. ..... 2/312; 2/300
(58) Field of Search ..... 2/338, 300, 310–323, 2/80, 83, 76, 221, 229, 237, 920, 44–45, 94; 128/95.1, 99.1, 100.1, 869

(56) References Cited

U.S. PATENT DOCUMENTS

| | | | | |
|---|---|---|---|---|
| 2,185,834 A | * | 1/1940 | Creper | 450/134 |
| 5,214,806 A | | 6/1993 | Flores | |
| 5,309,572 A | | 5/1994 | Seamens | |
| 5,560,046 A | * | 10/1996 | Iwamasa et al. | 128/101.1 |

FOREIGN PATENT DOCUMENTS

| | | |
|---|---|---|
| DE | 32 28 720 | 2/1984 |
| FR | 2 559 652 | 8/1985 |
| FR | 2 682 568 | 4/1993 |
| GB | 1 589 300 | 5/1981 |

* cited by examiner

*Primary Examiner*—Gloria M. Hale
*Assistant Examiner*—Tejash Patel
(74) *Attorney, Agent, or Firm*—Dykema Gossett PLLC

(57) ABSTRACT

The invention realizes a connecting band between garments covering the upper and lower part of the body, that will close on itself and be secured to a garment or a part of it. A bearing number of protruding tabs (2) can be attached in a removable way to at least one of said garments or part of it by means of pressure fastenings present in the tabs.

18 Claims, 3 Drawing Sheets

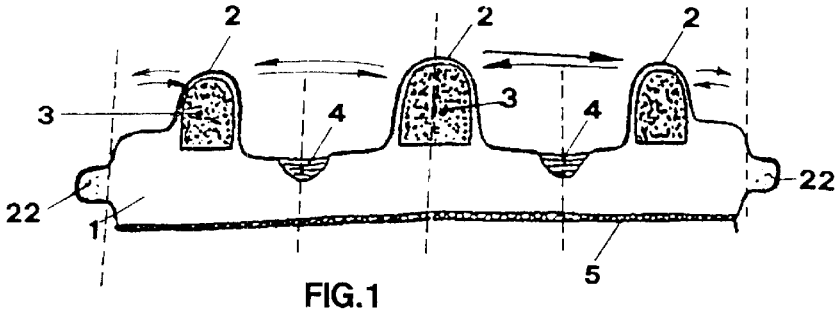
FIG.1
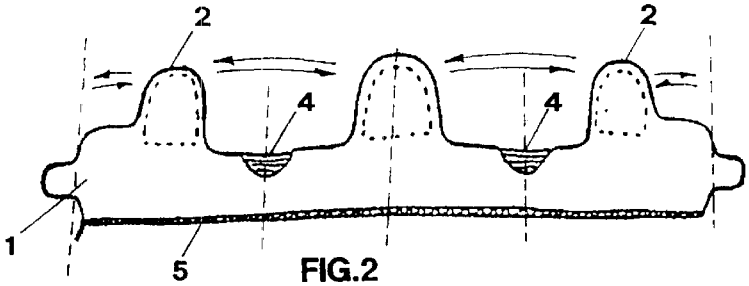
FIG.2
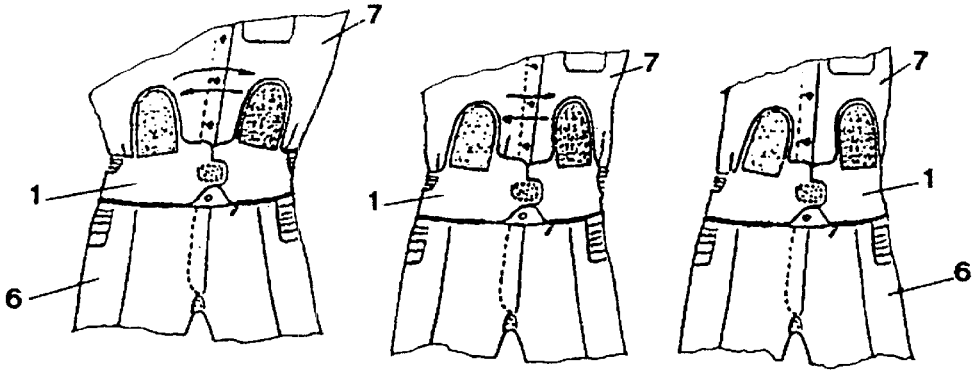
FIG.3
FIG.4
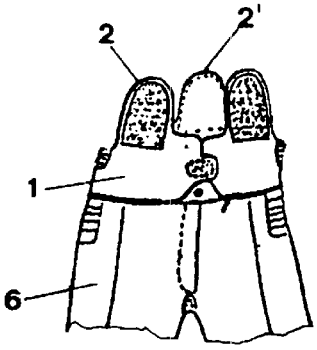
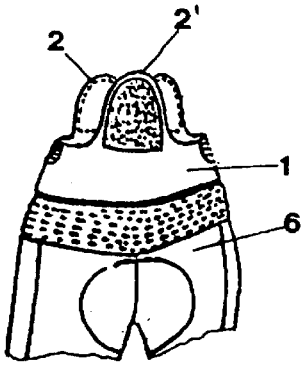
FIG.5

CONNECTING BAND BETWEEN ARTICLES OF CLOTHING OR PARTS OF THEM

The invention concerns a band or connecting belt between articles of clothing or parts of them covering the upper and lower part of the body respectively.

It is well known that there are articles of clothing, such as overalls, that can cover both the upper and the lower part of the body giving compact covering and protection to the body itself. Motorcycle overalls should be mentioned specifically since they can be separated by means of a perimetrical fastener connecting the pants to the jacket, and by means of which a rigid type of connection is made.

There are also other kinds of overalls such as those for work or similar purposes where jacket and pants cannot be separated, consenting only an opening large enough to put on the overalls.

The inventor is not acquainted with overalls or other articles of clothing that can be connected in their upper or lower part, at the same time adjustable in fit, in the sense that they can be adjusted to different persons and needs. More specifically, the inventor does not know of overalls in which jacket and pants can be adjusted one to the other in such a way as to vary the distance between crotch and waist, or at any rate between jacket and pants. DE-A-3228720 discloses a special zip-fastener connection between jacket and trousers in a suit for motorcyclists in which continuous pressure fastenening means are provided in said zip-fastener to connect said clothes.

U.S. Pat. No. 5,214,806 discloses an infant garment band including a plurality of fastener members extending above and below the band for securement of a tee shirt and a diaper.

FR-A-2682568 discloses a device to secure garments worn on the lower half of the body to be attached to garment worn of the top of the body wherein each garment is attached diretly to another garment.

In particular, according to the technique used in motorcycle overalls elasticized parts have been designed giving adherence to the body of the user and providing perimetrical connection by means of a fastener that joins the pants to the jacket also with an elastic band which however does not consent extensive tolerance in size, especially as regards the person's height.

A further limit limit in present technique is the difficulty of adapting the overalls to different uses, while remaining within the main use, such as spots, for instance.

We mention as an example the case of motorcyclist overalls that may have different size requirements according to whether the motorcyclist is driving a sports motorcycle with low handlebar or one with high handlebars. Obviously the need for size adaptability and of the overalls' reaction to body adherence is different in the two instances, but normal overalls do not suit these different requriements, and therefore the only way of wearing the same overalls and using them in these two different situations is to buy a slightly larger size so that it can be naturally adjustable to the two positions.

Another limit of present technique is to prevent adjustment of the same size to different people. That is to say, overalls that are of a specific size—say large-used by a person of a specific height cannot be worn with an equal fit by a shorter person or vice versa.

In other words, according to present technique each person needs to wear his own size and overalls cannot be lent or used by other persons.

The purpose of this invention is to overcome the limits of present technique. In particular it is the purpose of this invention to create a composite garment made up of jacket and pants with high adaptability to the situations for which it is used, as well as to the persons using it.

Another purpose of the invention is to make it possible to modify length, angle and joint of the jacket sleeve, just to meet the different size requirements of people with more or less long and more or less heavy arms and shoulders.

In substance the point is to obtain a range of fit with essentially unvaried garment comfort that can be extended to different persons wearing different sizes, and to different situations.

The invention also aims at reducing the number of suit sizes in order to lower amounts in stock, and in fact the possibilities of use of the same size by a greater number of consumers would be increased.

The a above mentioned purposes, and others that will be brought out further on, are attained by means of a connecting band between garments covering the upper and lower parts of the body, such as jackets and pants, or only the upper part, such as jackets with sleeves. This band which closes on itself and is secured to one garment or part of one, and, according to its primary purpose, is characterized by bearing a number of tabs protruding obliquely to the longitudinal axis of said band, suitable for fastening and unfastening to at least one of said articles of clothing or part of it by means of snap fasteners located on said tab and articles of clothing.

According to the invention this connecting band which can be fastened to one of the two garments, for instance pants or jacket , by means of easily removable fastening devices such as Velcro®, widens the range of fit of the overalls to great advantage by allowing easy mutual approach and removal of two articles of clothing—the jacket or the pants—at the waistline. Furthermore, a so-called "sliding" backward and forward effect is obtained, since the mutual fastening of jacket and pants can be adjusted to various positions: for instance, forward approaching and backward removing, in order to meet different requirements.

The band of the invention can also be used to alter the joining of the sleeves to the jacket, thus adjusting—by positioning the sleeves differently—the size of the shoulders and the length, angle and joint of the sleeves to provide the best possible fit for the wearer.

Another advantage of the invention is to reduce the number of garment sizes, while assuring a wide range of fit to a considerable number of people as though the number of sizes had remained the same.

Another advantage of the invention is to reduce the number of garment sizes, while assuring a wide range of fit to a considerable number of people as though the number of sizes had remained the same.

This application of the invention could be advantageous in specific sectors, besides sports, such as the military, the fire department, civilian emergency aid, in which special outfits are worn, and where it is now necessary to have different sizes available for the personnel, in order to assure a satisfactory fit.

Due to this invention now the number of sizes can be drastically reduced, while guaranteeing a good fit by means of the connecting band.

Further characteristics and peculiarities of the invention will be better illustrated in the description of special examples of performance given indicatively, though not limitedly, and illustrated in the enclosed diagrams, where:

FIG. 1 shows the outside of the band of the invention;

FIG. 2 shows the inside of the invention band;

FIG. 3 shows three different combinations of the invention band applied to extra-large, regular or slender size person using the same garment or different size garments;

FIG. 4 shows the invention band fastened to a pair of pants seen from the front;

FIG. 5 represents the same pair of pants seen from the back;

With reference to FIG. 1, it will be noted that the invention band, indicated on the whole as 1, is made of flexible material which could be for instance strong material or leather or even a plastic material.

The band in question shows a series of tabs 2 protruding upward and obliquely to the longitudinal axis of the band itself.

Corresponding to this tabs there are areas of so-called "male" Velcro material, as indicated in 3. This material is suitable for adhesion by pressure to corresponding areas of so-called "female" Velcro material that are present on the inside of jacket which with the pants makes up the outfit. To improve the adjustment of the belt to the waistline, in the example there are also some elasticized areas 4, in the event the material of which the band is made is not elastic as well. The invention band has a zipper underneath 5, and, as can be seen in FIG. 4 and 5, for fastening of this band to the overalls pants.

Figure 6:
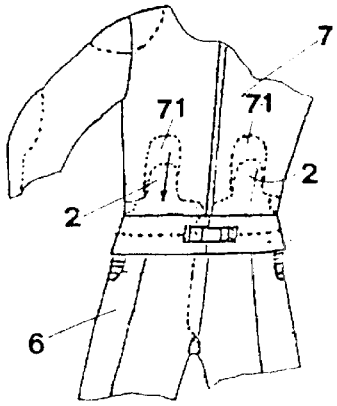
FIGS. 6, 7 and 8 show how the invention band is connected to a jacket in an outfit worn by persons of three different sizes, i.e. large, medium and small.
Figure 7:
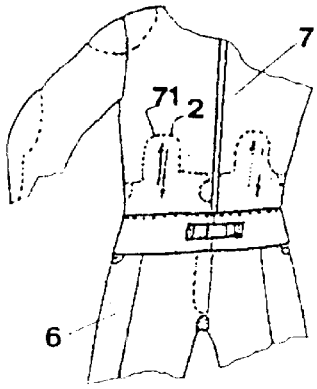
Figure 8:
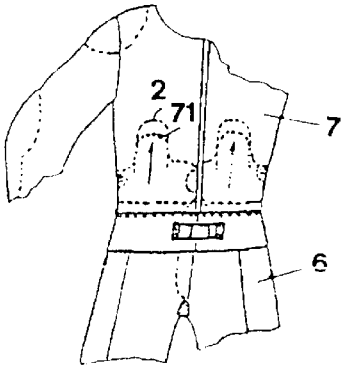

Once the band is attached to the pants, it is clear that the connection between the pants and therefore also between this band and the jacket can be made in differnt positions, as may be observed in FIG. 6, 7, and 8; it can be seen here, for instance in FIG. 6, where tabs 2 are attached to the corresponding areas of female Velcro 71 of the jacket 7 relatively low, because jacket 7 is worn by a tall person. On the contrary, in the event that instead, as in FIG. 8, the same jacket 7 is worn by a shorter person, obviously the connection between the tab 2 bearing male Velcro and are 71 with female Velcro appears inverted in the sense that the tab 2 is above and completely covers the area of female Velcro 71 belonging to the jacket 7. The situation will be essentially balanced with a medium size person where the two tabs belonging to the band and the jacket actually coincide.

Figure 9:
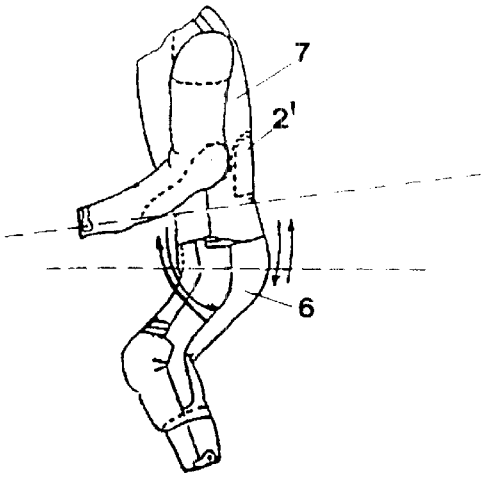
FIG. 9 shows the back adjustment of the invention band to the jacket of sports overalls when the position taken is essentially a standing one.
Figure 10:
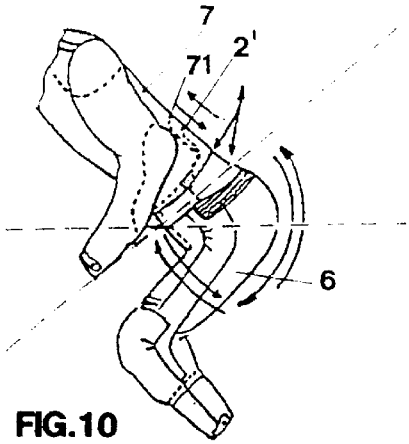
FIG. 10 shows the different way of fastening the same band on the same garments in a situation in which the person's position is bent over.

Still looking at FIG. 4 and 5 it can be seen that the tabs of the band which, in the example in FIG. 1, are three in number, are distributed two in the front and one in the back indicated with 2'. Tab 2', in FIG. 9, can be seen to be superimposed to the area of female Velcro of jacket 7. This is due to the fact that in this case the motorcyclist is in an erect position since the handle bar is of the high type. On the contrary, in the instance as observed in FIG. 10, where the motorcyclist takes a position inclined over the handle bar, the position of tab 2' will be different, in this case lower with respect to the upper edge of the female Velcro 71 area on the jacket.

As can be seen the possiblility of adjusting both to different sizes and different uses, is provided by the possibility of connecting in different ways the jacket to the band and therefore essentially the jacket to the pants.

Figure 12:
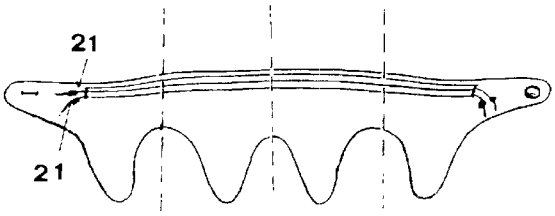
FIG. 12 shows a variation of the invention band with a slide fastener to model the same band at the wastline.
Figure 13:
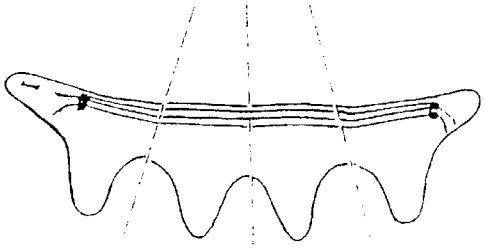
FIG. 13 shows the FIG. 12 band modeled by the slide fastener action.

In order to increase the fit of the invention band, the latter is provided—as shown in FIG. 12 and 13 with one or more slide fasteners 21 the length of which can be altered at will to obtain curvature of the band and therefore its correct adherence to the waistline. It can also be seen that the fastening of the band at the waistline is by overlapping of the two tabs 22 which are also provided with male and female Velcro respectively.

Figure 11:
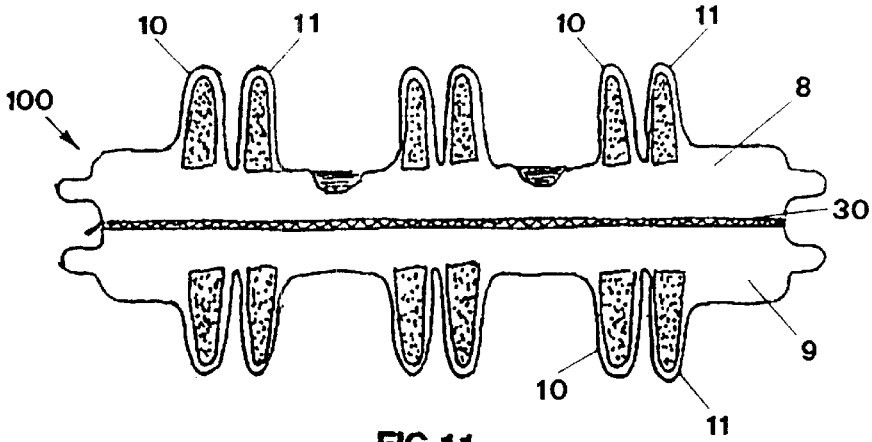
FIG. 11 shows a variation of the blet in FIG. 1.

FIG. 11 shows an enforceable variation of the invention band in which it can be seen that the tabs projecting in an oblique direction to the band are arranged in pairs as shown in 10 and 11, and what is more are present in both oblique directions with respect to the longitudinal axis where there is a zipper 30. This way the band, indicated as a whole with 100, secures with its tabs both the jacket as well as the pants, and the overalls are opened by the zipper 30 separating jacket and pants respectively. The presence of the zipper 30 also makes it possible to use just one part of the band, for instance part 8, to put only the jacket on, or just part 9 to put only the pants on. In this case the half band will simply be properly tightened at the waist before putting on one of the two garments.

Figure 14:
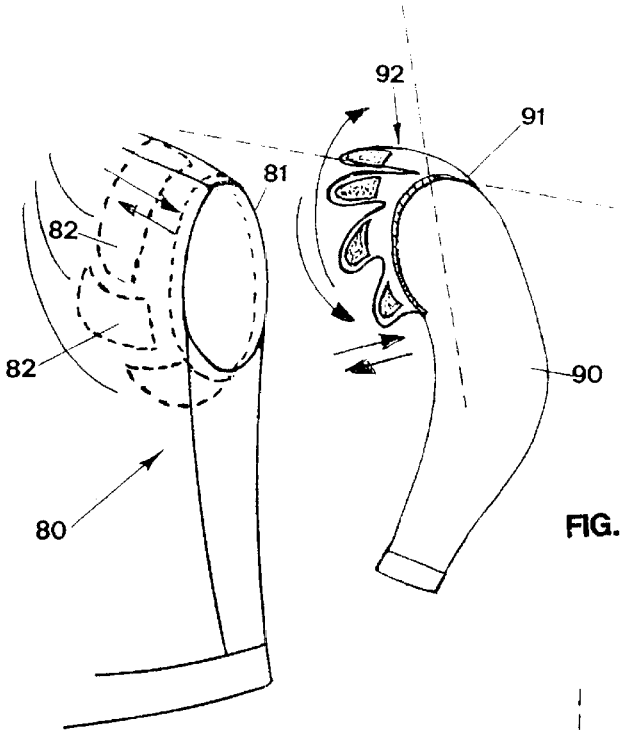
FIG. 14 shows the invention band applied to a sleeve to be connected to a jacket.
Figure 15:
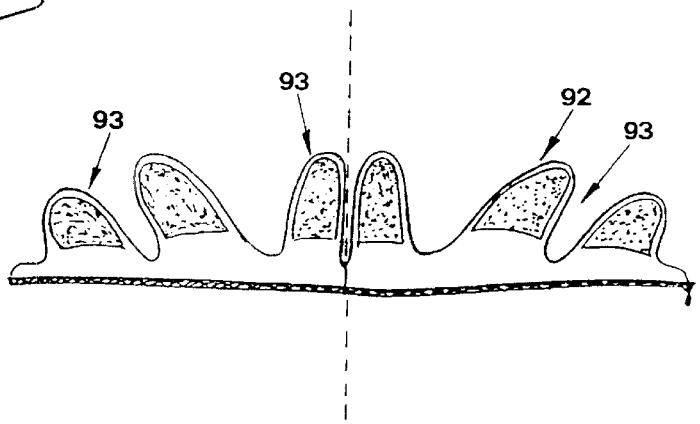
FIG. 15 shows distribution of the tabs on the band.

In FIG. 14 and 15 another interesting application of the invention band is shown, in this case attaching a shoulder to the jacket.

More specifically, in FIG. 14 it can be seen that the jacket, now indicated as a whole with 80, shows in correspondence with joint 81 of shoulder 90, and inside the jacket itself, areas 82 with female Velcro sewn in. The sleeve 90 shows, connected by means of zipper 91, the invention band now indicated as a whole with 92, which is provided with pairs of tabs 93 with male Velcro application.

It is evident that the sleeve 90 can be secured to the jacket 80 by altering the shoulder joint, that is causing the sleeve to project outwards, or drawing it back in towards the jacket, and also with a slant of the sleeves according to the user's fitting requirements.

Needless to say also the length will vary according to where the joint is made, further outside or inside toward the jacket.

Thus also in this case a garment like the jacket is allowed greater flexibility and better fit according to the person wearing it, without having recourse to different sizes.

It is also important to observe that the invention band can be used with any article of clothing, even made of fabric, provided this garment is equipped with adequate fastening points or areas with Velcro or other equivalent quick fastening device by adherence.

To be noted as well that the invention band also acts as a general fastening device, that may be used in particular in the summer time or in city outings when the use of an outfit for instance made of leather would be hardly welcome and rather unpleasant.

It will consequently be possible to attach to the invention band to vest, jackets, ets. even of normal fabrics and in combination with leather pants. From the above, it would appear evident that all the purposes of the invention have been attained.

In fact it has become possible to provide maximum fit to overalls equipped with the invention band even by people wearing different sizes. Consequently it is possible to drastically reduce the number of sizes to be worn by different people.

It is also possible to combine different garments, even in different fabrics and sizes, as long as they are provided with the suitable fastening devices to apply the tabs of the invention band.

What is claimed is:

1. A connecting band between garments covering the upper and lower part of the body, that will close on itself and be secured to a garment or a part thereof, bearing a number of protruding tabs on one side of the connecting band only in an oblique position with respect to the longitudinal axis of the band that can be attached in a removable way to at least one of said garments or part thereof by means of pressure fastenings present in said tabs and garment, the other side of the connecting band bearing a zipper connecting the band to the garment.

2. A connecting band according to claim 1, wherein the pressure fastening is comprised of a hook and loop fasteners.

3. A connecting band according to claim 1, wherein said band bears between the tabs at least one area made of elastic material that makes it flexible enough to give said tabs more convergence or divergence with respect to their rest position.

4. A connecting band according to claim 1, wherein said band bears in the essentially central area a linear and flexible slide fastener capable of modeling the basically linear shape of the band into a curved shape making it adherent to the hips of the wearer.

5. A connecting band according to claim 1, wherein said band closes on itself by means of two superimposable tabs with hook and loop fasteners.

6. A connecting band according to claim 1, wherein the tabs protruding in an oblique direction from this band are distributed in pairs spaced one from the other.

7. A connecting band according to claim 1, wherein the tabs or pairs of tabs on this band are three, two of them in front and one behind in correspondence of the back of the wearer.

8. A connecting band according to claim 1, for fastening together a jacket and pants.

9. A connecting band according to claim 1, for fastening together sleeves and a jacket.

10. A connecting band between garments covering the upper and lower part of the body, that will close on itself and be secured to a garment or a part thereof, bearing a number of protruding tabs on both sides of said band in an oblique position with respect to the longitudinal axis of the band that can be attached in a removable way to at least one of said garments or part thereof by means of pressure fastenings present in said tabs and garment, and said band is divided into two parts by means of a zipper set along the longitudinal axis of the band.

11. A connecting band according to claim 10, wherein the pressure fastening is comprised of a hook and loop fasteners.

12. A connecting band according to claim 10, wherein said band bears between the tabs at least one area made of elastic material that makes it flexible enough to give said tabs more convergence or divergence with respect to their rest position.

13. A connecting band according to claim 10, wherein said band bears in the essentially central area a linear and flexible slide fastener capable of modeling the basically linear shape of the band into a curved shape making it adherent to the hips of the wearer.

14. A connecting band according to claim 10, wherein said band closes on itself by means of two superimposable tabs with hook and loop fasteners.

15. A connecting band according to claim 10, wherein the tabs protruding in an oblique direction from this band are distributed in pairs spaced one from the other.

16. A connecting band according to claim 10, wherein the tabs or pairs of tabs on this band are three, two of them in front and one behind in correspondence of the back of the wearer.

17. A connecting band according to claim 10, for fastening together a jacket and pants.

18. A connecting band according to claim 10, for fastening together sleeves and a jacket.

* * * * *